United States Patent [19]

Blankinship

[11] 3,947,638

[45] Mar. 30, 1976

[54] PITCH ANALYZER USING LOG-TAPPED DELAY LINE

[75] Inventor: William A. Blankinship, Annapolis, Md.

[73] Assignee: The United States of America as represented by the Secretary of the Army, Washington, D.C.

[22] Filed: Feb. 18, 1975

[21] Appl. No.: 550,309

[52] U.S. Cl. ..... 179/1 SA; 328/55

[51] Int. Cl.[2] ..... G10L 1/00

[58] Field of Search ..... 179/1 SA, 1 SC; 328/55

[56] References Cited

UNITED STATES PATENTS

| | | | |
|---|---|---|---|
| 2,908,761 | 10/1959 | Raisbech | 179/1 SC |
| 3,069,507 | 12/1962 | David | 179/1 SA |
| 3,071,652 | 1/1963 | Schroeder | 179/1 SA |
| 3,344,349 | 9/1967 | Schroeder | 179/1 SA |

*Primary Examiner*—Kathleen H. Claffy
*Assistant Examiner*—E. S. Kemeny
*Attorney, Agent, or Firm*—John R. Utermohle; Thomas O. Maser

[57] ABSTRACT

A pitch analyzer is described which extracts, on a real-time or pipeline basis, the pitch information from a speech signal. The analyzer converts the speech signal to a digital signal, shifts it into a delay line tapped at logarithmic intervals and constructs a measure of merit for each of many possible pitch periods. These measures are periodically transferred to a processor which combines them in a prescribed manner with previous information to select the one most-likely current value of pitch. Provision is also made, when the application warrants it, to select the best pitch value, with a delay of several frames, based on current information.

4 Claims, 10 Drawing Figures

PITCH ANALYZER USING LOG-TAPPED DELAY LINE

BACKGROUND OF THE INVENTION

This invention relates generally to the field of communications, and more specifically to the processing of analog speech signals to extract pitch information therefrom.

The problem of deriving pitch information from a speech signal occurs in nearly all aspects of speech processing, particularly in the vocoder or linear predictive coding area, where one must, after deriving an instantaneous model of the vocal tract, provide a suitable excitation, or fundamental tone, to that model in order to reconstruct the speech. Devices have been developed over the past several years to accomplish this purpose, but all have disadvantages which are solved by this invention. Devices which analyze a signal by first stepping the signal into a shift register tapped at regular intervals have significantly reduced accuracy as the pitch period decreases, and they require significantly increased processing time because of unnecessary accuracy at longer pitch periods. Other devices have attempted to derive pitch by locating regularly-occurring peaks in the speech signal. These devices are ineffective if the signal contains significant amounts of noise. Many pitch tracking processes either require extensive amounts of logic and computation (such as Fourier transforms) or require several passes through the speech signal, thereby prohibiting implementation in real time. It would be desirable to have a pitch analyzer which would overcome these disadvantages, and it is to this end that this invention is directed.

BRIEF SUMMARY OF THE INVENTION

It is well known that the excitation in voiced speech is only quasi-periodic, so it is difficult to measure pitch periods precisely. However, for most applications, neither the exact times of occurance of glottal pulses nor the exact intervals between them are required. This apparatus does not attempt to measure the exact pitch period, but rather derives a pitch "trajectory" of maximum likelihood such that, if the trajectory were used to excite a vocoder or linear predictive coder, a listener would consider the reconstructed speech to be closely similar to the original. This is accomplished by converting the analog speech signal to a digital signal, introducing the digital signal into a delay line, tapping the signal at logarithmic intervals, comparing these tapped signals with other portions of the signal to obtain a measure of likelihood of a number of possible pitch periods according to a predetermined rule, and evaluating these measures in the light of past history to select the single best pitch period.

Accordingly, it is an object of this invention to provide an apparatus for deriving pitch information from a speech signal.

It is also an object to provide a pitch analyzer which has a uniform accuracy, or resolution, for all pitch periods.

It is a further object to provide a pitch analyzer which will operate reliably despite a noisy signal.

It is still a further object to provide a pitch analyzer which will operate in real time without significant processing delays.

It is a further object to provide a pitch analyzer which may be built cheaply with readily available hardware.

A pitch analyzer having these and other desirable characteristics might include a source of data bits carrying information about the amplitude curve of a speech signal to be analyzed, a delay line adapted to receive the data bits and including the necessary means for extracting certain of the data bits at logarithmic intervals along the delay line; and a processor for receiving the extracted data bits and producing an electrical signal representative of the amplitude period of the speech signal.

THEORY OF OPERATION

Figure 1:
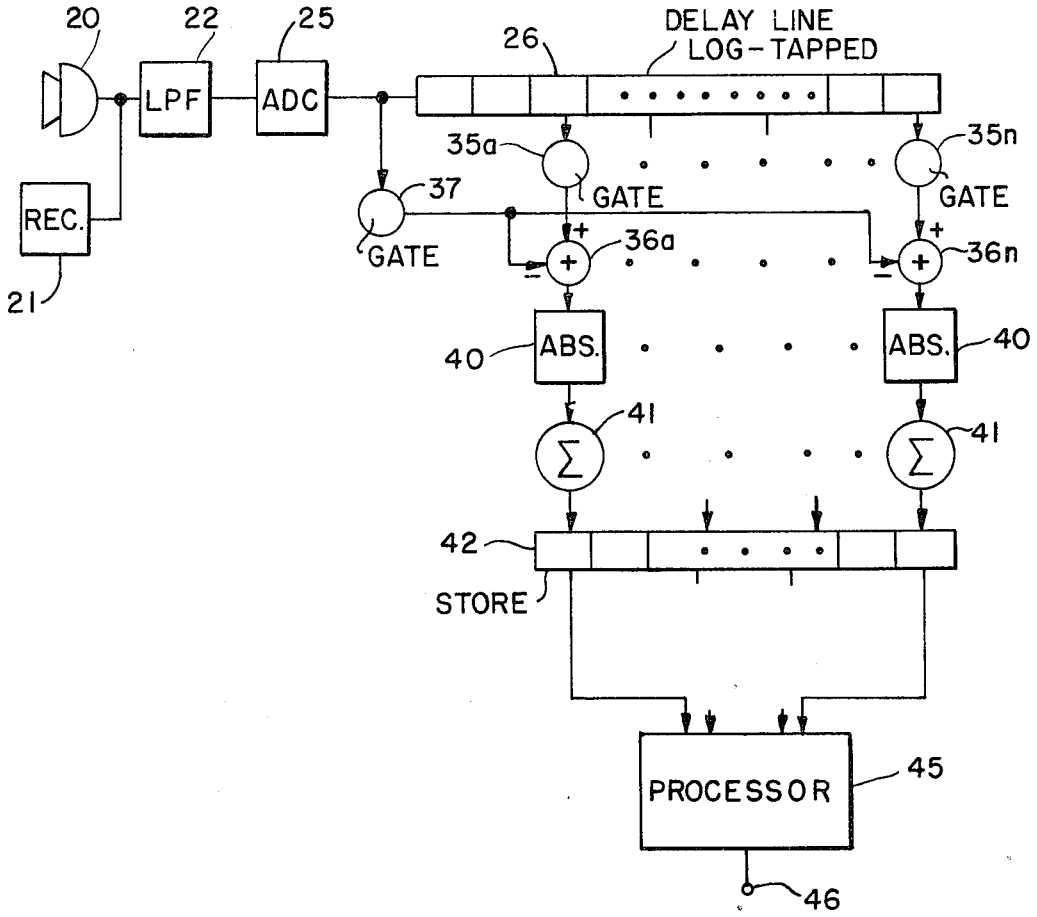
FIG. 1 is a block diagram of a pitch analyzer embodying the invention.

A pitch analyzer having the desirable qualities listed above may be constructed to operate on an analog speech signal in substantially the following manner. The speech signal is converted into a digitized electrical representation suitable for storage and manipulation. A series of values is derived from this digitized signal. Each such value associates with one of a preselected set of pitch period "candidates" a rough estimate of the likelihood of that candidate as the current value for the pitch period. These signals are sampled periodically, for example once every 10 milliseconds (a "frame"), and transferred to a processor for selection of a best value. In the example to be described in detail below, the function A(t, i) represents these sampled signals and is a measure of the "unlikelihood" for the various pitch period candidates, $\tau_i$. Thus, A(t, i) would be small when $\tau_i$ (t) is likely and large when $\tau_i$ (t) is unlikely. While a seemingly simple solution is to choose for each $\tau$ the value $\tau_i$ which minimizes the function A(t,i), this approach fails an unacceptable proportion of the time for "clean" speech and falls apart completely for noisy speech. The approach employed in this invention is to consider a sequence of periods $\tau_i$ , $\tau_i$ , . . . . $\tau_i$ for each frame, such that a. $A(j,i_j)$ is small, and b. $\tau_{i_t}$ does not differ radically from $\tau_{i_{t-1}}$ .

This second requirement is based upon a known characteristic of pitch, i.e., that pitch does not commonly vary radically in a short time interval. To evaluate the relative measures of several such sequences, one may assign a "score" or "cost" to any such sequence as follows:

$$S(i_1, i_2, \ldots i_t) = \sum_{j=1}^{k} [A(j, i_j) + f_t(i_j, i_{j-1})]$$

where $f_t(i_j, i_{j-1})$ is small when $i_j$ and $i_{j-1}$ are close, and large when they are far apart. $A(t, i)$ may be thought of as the intrinsic "cost" of choosing $\tau_1$ at time $t$, and $f_t(i_j, i_{j-1})$ may be considered the cost of changing from pitch $\tau_i$ at time $j-1$ to $96_i$ at time $j$. Thus the cost of a sequence of successive pitch values is the total of their intrinsic costs plus the sum of the transition costs. It has been determined that useful results are obtained with the following functions:

$A(t, i)$ = AMDF function (more fully defined below)

$$f_t(i_j, i_{j-1}) = \alpha_t |\log(\tau_j/\tau_{j-1})|$$

where $\alpha$ is a slowly varying scalar value which may be thought of as the "inertia" of the pitch tracker. Rules for proper selection of the value $\alpha$ are found hereinbelow.

In the preferred embodiment, 30 candidates for pitch period are selected for each frame of speech. The value "30" may be changed over a broad range for varying applications, the value being determined principally by the degree of accuracy desired. At a sampling rate of 0.125 msec per sample and 80 samples per frame, 5 seconds of speech contains 500 frames and thus $30^{500}$ possible sequences of pitch values. Obviously, the time and speed necessary to evaluate the cost of each such sequence at a feasible rate is beyond the limits even of computers, but a process, utilizing the concepts of dynamic programming, has been developed to perform the evaluation in an efficient manner. The work required per frame is a linear function of the number of pitch candidates, and the incremental cost from frame to frame is constant. To accomplish this, one computes, for each frame $t$, two arrays, defined as follows:

$W_t(i)$ = the cost of the cheapest sequence of pitch values that end with $\tau_i$ at time $t$.

$P_t(i)$ = the index of the immediately preceeding pitch period in the cheapest sequence just referred to.

$W_t(i)$, to be referred to as the "winner function", needs only to be kept current, while the "pointer vectors" $P_t(i)$ need to be saved for the number of frames for which the pitch decision is to be delayed. These functions are easily computed recursively as follows:

$$W_1(i) = A(1, i)$$

$$W_{t+1}(i) = A(t1, i) + \min_j [W_t(j) + +I, t(i, j)] \quad (1)$$

$P_{t+1}(i)$ = value of $j$ which minimizes the above expression.

Having computed $W_t(i)$ one can see that the best, or optimum, choice of pitch period for the current frame is that $\tau_i$ for which $W_t(i)$ is minimum. Further, the best choice for the preceeding frames are the periods corresponding to $P_t(i)$, $P_{t-1}[P_t(i)]$, $P_{t-2}\{P_{t-1}[P_t(i)]\}$, etc. In practice, the function $W_t(i)$ is diminished by its minimum value prior to the computation of $W_{t+1}(i)$ to prevent its growing out of bounds.

While it would appear that the computational work of formula (1) above is proportional to the square of the number of pitch candidates, an implementation has been developed in which the work is a linear function of the number of pitch candidates.

First, by choosing logarithmic tapping to select the $\tau$-values, a given increment or decrement in the index, i, of the $\tau$-value always corresponds to the same chromatic interval. Therefore, the function $f_t(i, j)$ of formula (1) becomes trivial to evaluate because:

$$f_t(i,j) = \alpha_t |\log(\tau_i/\tau_j)| = \alpha_t |i-j|,$$

and the equation (1) becomes $$W_{t+1}(i) = A(t+1, i) + \min_j [W_t(j) + \alpha_t |i-j|]. \quad (2)$$

The function $A(t, i)$, to be called the *Absolute Magnitude Difference Function*; or AMDF, measures the dissimilarity, over the recent past, of the speech signal to itself at offset $\tau_i$. Small values of $A(t,i)$ constitute a "vote" for $\tau_i$ as the correct pitch period. If s(t) is the conditioned speech signal, the AMDF is the attenuated sum, over the recent past, of $|s(t) - s(t-\tau_i)|$. In this embodiment, 30 values of $\tau$ selected at logarithmic intervals are used, and these absolute differences are accumulated, every fourth sample, with a decay rate of 31/32 per four samples, and examined once per frame.

Concentrating on the second summand of the equation (2) above, the "intermediate winner function", $\overline{W}(i)$ is defined:

$$\overline{W}_{t+1}(i) = \min_j [W_t(j) + \alpha_t |i-j|].$$

Figure 3:
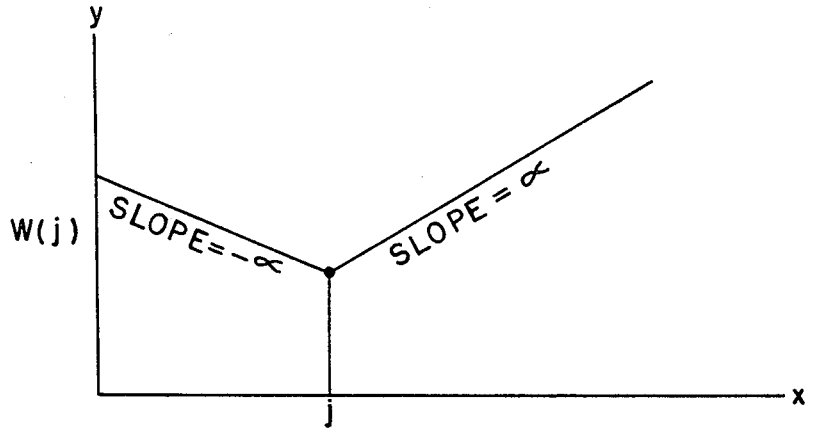
FIG. 3 is a graphical representation of one point of the curve reconstructed by the selection process.

The value $\alpha$ may be visualized as the slope (plus and minus) of a pair of rays emanating from a point at height $W(j)$ at $x = j$ on an $x$–$y$ coordinate system as shown in FIG. 3, which represents $W_t(j) + \alpha |i-j|$ for a fixed value of $j$. As $\alpha$ is made large, the slope increases, and conversely, as $\alpha$ is made smaller the slope similarly decreases. For best results, it is desired that $\alpha$ be large when following the trajectory of slowly changing pitch and when more reliance is to be put on the previous AMDF's than on the current one. The value $\alpha$ should be small for the capability to follow rapid pitch changes and when greater reliance may be placed on the current AMDF. In practice it has been found that $\alpha$ should be proportional to the minimum value, $m$, of $A(t+1, i)$, the proportion varying with the particular $\tau$-values chosen. In this embodiment $\alpha = (2/5)m$ has been found to give excellent results, but values of $\alpha$ between $m/2$ and $m/4$ were found to be satisfactory. In these latter cases, the actual arithmetic division could be replaced by a simple shift. In general, $\alpha = 4m/$(number of $\tau$-values per octave) gives good results. Results may be further improved by preventing great fluctuations in $\alpha$. This may be done by reinitializing $\alpha$ to the above selected value at each onset of voicing and subsequently accumulating the new value with some decay rate, for example, 7/8, per frame during voiced intervals.

The actual calculation for the intermediate winner function takes advantage of the precursive linear nature of the function $$W_t(j) + \alpha_t |x-j|.$$

If we define $$\overline{W_1}(x) = \min_{j \leq x} [W_t(j) + \alpha_t |x-j|].$$

then $$\overline{W_t}(x) = \min_{j \geq x} [\overline{W_1}(j) + \alpha_t |x-j|].$$

Figure 4:
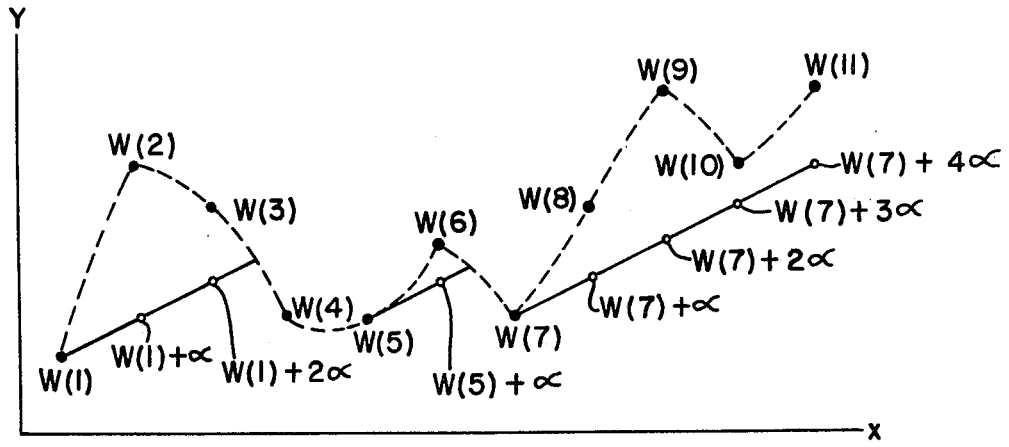
FIG. 4 is a graphical representation of several points of the curve reconstructed by the selection process after the left-to-right pass of the processor.

The above minimizations are accomplished as follows: referring to FIG. 4, the analyzer operates by starting at $x=1$ and following the ray $W_t(1) + \alpha\,|x-1|$, by incrementing $x$, until it exceeds $W_t(x)$ at, for example, $x=j$. Then, $W_t(j) + \alpha\,|x-j|$ is followed until it becomes greater than $W_t(x)$. The process is contined, always following a ray until it becomes greater than $W_t(x)$ and then picking up the ray emanating from that point. During this process it is necessary to record $\overline{W_1}(x)$ = value of ray currently being followed $Q_1(x)$ = number (or source point) of current ray. It may be noted from FIG. 4 that "following" a ray means simply incrementing the base value by the amount $\alpha$ each time $x$ is incremented by one.

$\overline{W_t}(x)$ and $P_t(x)$ may be computed in a similar manner by starting at the right and following the left-pointing rays, $\overline{W_1}(x) + \alpha_t\,|x-j|$, decrementing $x$ and choosing $P_t(x) = Q_1(j)$ where $j$ is the base of the "winning" ray at $x$.

Adding the computed vector $\overline{W}_t$ of 30 values to the next series of 30 AMDF values gives the 30 values for $W_{t+1}$ of the equation (2). The minimum of these values indicates the best choice among the 30 $\tau$-values provided the choice is made without processing delay. An additional advantage is realized, however, when that choice is delayed some number of frames, for example 3. Then, the advantages of hindsight may be utilized to determine a best estimate based on the data which follows, as well as on that which came before. The pointer vector P is used to this end, with the necessity of storing all computed P vectors from the present back to the frame in which the delayed decision is made. That is, when the present best choice for zero delay is determined as above, that choice is traced back thru the pointers for 3 frames, and the $\tau$-values for pitch period is selected based on the knowledge obtained from the additional analysis of the 3 succeeding frames.

DESCRIPTION OF THE PREFERRED EMBODIMENT

FIG. 1 shows, in block diagram form, a pitch analyzer having the desirable qualities described herein above, resulting from the invention. An analog speech signal serves as the input to the apparatus. This input may be in the form of speech spoken directly into a microphone 20 or from a prerecorded source 21 such as a tape recorder. The analog electrical signal is fed thru a low pass filter 22 matched to the proposed sampling rate, an analog-to-digital converter (ADC) 25 and into a delay line 26. The analog-to-digital converter 25 should provide approximately 7 bits plus sign at a recommended sampling rate of 8,000 samples per second. Higher or lower rates may be used if greater or less pitch resolution is required.

The delay line 26 consists of a number of stages, each of which holds one sample (7 bits plus sign) from the ADC 25. The length of the delay line i.e., the number of stages, must be sufficient to hold a sample of speech whose length is greater than the greatest anticipated pitch period. In the preferred embodiment, a 148 stage delay line is used. The samples are sequentially shifted from left to right as a new sample enters the left-most stage. Thus, the 148th stage holds the value of the sample which entered the register 148 steps ago. In addition, certain of the stages can be read on a given signal applied to the gates 35*a* – 35*n* and 37, and transmitted to the adders 36*a* – 36*n*. The output of each of the adders 36*a* – 36*n* is passed through a device 40 which provides on its output the absolute value of the input. This value for each of the signals is accumulated in a "forgetful" accumulator 41, to be more fully explained herein below, with that output periodically sampled and held in a storage device 42. The components 35, 36, 37, 40 and 41 may operate at the sampling rate of the ADC 25, but acceptable resolution can be obtained at lesser rates which are a reciprocal of some integer (eg, ½, ⅓, ¼, etc.) times the ADC sampling rate. In the preferred embodiment, these components sample every fourth step, or at a rate of 2,000 samples per second. Periodically, for example every 10 msec, the values in storage device 42, which are the AMDF values defined previously, are transferred to a processor 45 which selects the best pitch value according to a predetermined rule and provides it to an output terminal 46.

In the preferred embodiment, the delay line 26 is composed of 148 delay stages. The stepping rate of the delay line 26 is the same as the sampling rate of the ADC 25, or 8,000 steps per second. It thus takes 148 × 0.125 msec or 18.5 msec for a given sample to propagate through the delay line 26.

For effective operation it has been determined that the signal in the delay line 26 need be transferred to the adders 36*a*–36*n* no more often than once every four samples (i.e., 4 × 0.125 msec), and the contents of the storage device 42 (i.e., the AMDF function) need be transferred to the processor 45 no more often than once every eighty samples (i.e., 80 × 0.125 msec or once per frame). This embodiment is so structured.

A considerable savings in circuitry and processing time may be realized by properly choosing the intervals, or numbers of stages, between taps of the delay line 26. Tapping every stage gives greater accuracy which is desirable for short pitch periods but is of little value for longer pitch periods, and greatly increases processing time. Tapping at greater intervals works well for longer pitch periods and significantly reduces processing time, but is inadequate for short pitch periods. The solution is to space the taps in a substantially logarithmic manner, with short intervals between taps at low periods and increasingly greater intervals between taps at higher periods. This provides uniform resolution for all pitch periods throughout the speech frequency spectrum. For this embodiment having 148 stages, tapping the following stages was found to work well:

| | | | | | | | | | |
|---|---|---|---|---|---|---|---|---|---|
| 20 | 21 | 22 | 24 | 26 | 28 | 30 | 32 | 34 | 37 |
| 40 | 43 | 46 | 49 | 52 | 56 | 60 | 64 | 69 | 74 |
| 79 | 85 | 91 | 98 | 105 | 112 | 120 | 129 | 138 | 148 |

with $\tau$=20 representing 400Hz and $\tau$=148 representing 54Hz. Stage "1" is the left-most stage of the delay line 26, and stage "148" is the right-most stage.

After each fourth step, the gate 35 is opened to allow the value stored in that column of the delay line to enter the adder 36. Simultaneously, the gate 37 is opened, allowing the value indicating the magnitude of the current signal to enter the adder 36. These values are subtracted and the sign is removed at 40, leaving the absolute value of the difference. This value is summed in a "forgetful" accumulator 41, and the sum is temporarily stored in a stage of the storage device 42.

Figure 2:
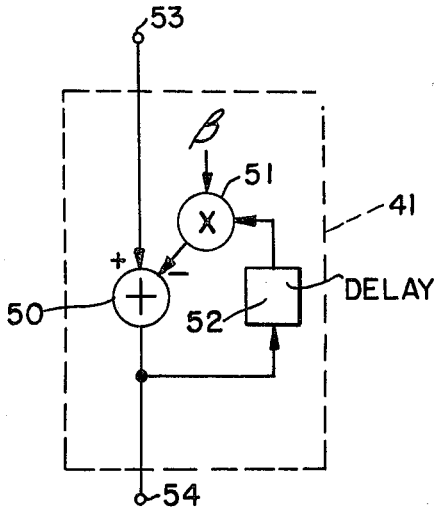
FIG. 2 is a more detailed block diagram of the accumulators of FIG. 1.

The forgetful accumulator 41 is shown in greater detail in FIG. 2. An adder 50 computes the sum of the absolute value of the difference from adder 36, applied to input terminal 53, and the value from a multiplier 51. This sum from the adder 50 is stored in a delay stage 52 and in a stage of the storage device 42, connected to the accumulator 41 through the output terminal 54. The value in the stage 52 is then multiplied by a constant value $\beta$ at 51, and this is fed back into the adder 50. The accumulator "forgets" because the constant $\beta$ is slightly less than unity, for example, 31/32. Hence, the value from the multiplier 51 is a function of the previous sums from the adder 50, but with each cycle the effect of the previous cycles is slightly diminished.

Figure 5:
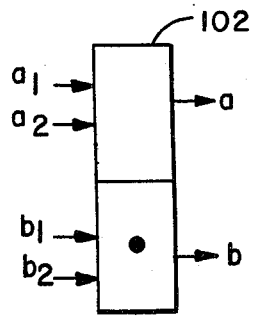
FIG. 5 is a block diagram of a switching circuit for use in the processor of FIG. 1.

An apparatus for performing the operation of the processor 45 is shown in block diagram form in FIGS. 6, 7, 8 and 9. To simplify these diagrams somewhat, a logic circuit 102 is defined as shown in FIG. 5. It is a 4-input/2-output switching circuit which compares the inputs "$b_1$" and "$b_2$" and provides at output "$b$" the lesser of the two input values. The input "$a_1$" or "$a_2$" is switched to output "$a$" according to the rule: $a = a_1$ if $b = b_1$; $a = a_2$ if $b = b_2$. No detailed description of this switch is provided as its design is easily within the abilities of one skilled in the art.

Figure 6:
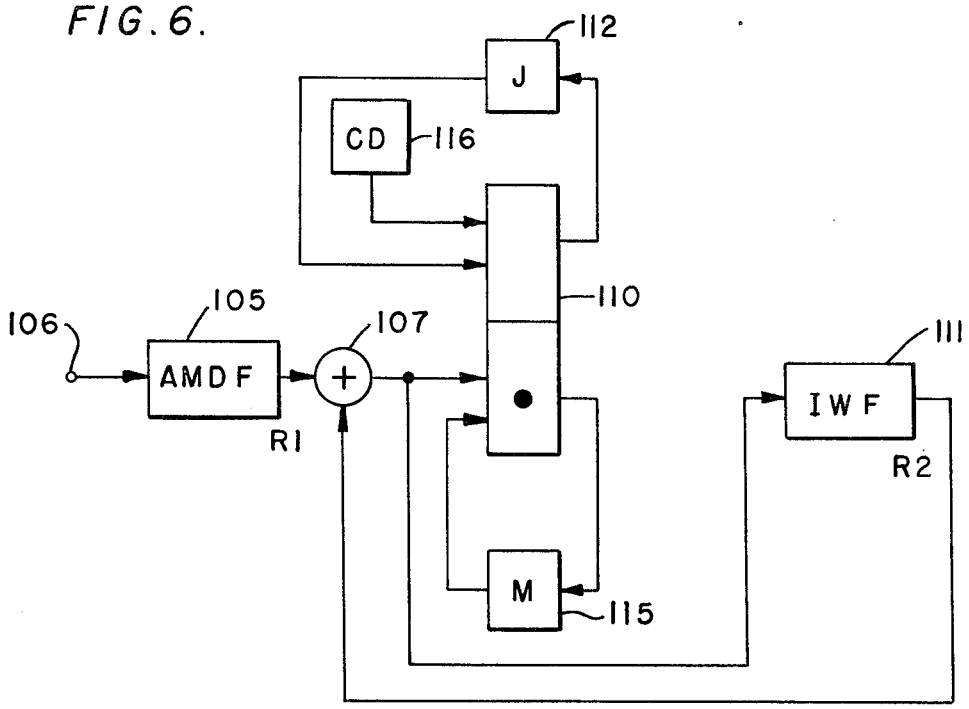
FIG. 6 is a block diagram of the phase 1 connection of the processor of FIG. 1.

The processing of one 30-long sample of AMDF's may be accomplished in four phases consisting of 30 steps each, the first of which is shown in FIG. 6. A delay line 105 consisting of 30 stages, has an input provided at terminal 106 from the storage device 42 (FIG. 1) and an output to an adder 107. The adder 107 is connected to the "$b_1$" input of a switching circuit 110 and also to a delay line 111 consisting of 30 stages. A second input to the adder 107 comes from delay line 111. The $b$ output of circuit 110 is connected to a delay stage 115, which provides the $b_2$ input of the circuit 110. A delay stage 112 receives data from the $a$ output of the circuit 110 and provides data to the $a_2$ input of the circuit 110. The $a_1$ input comes from a "count down" counter 116.

Figure 7:
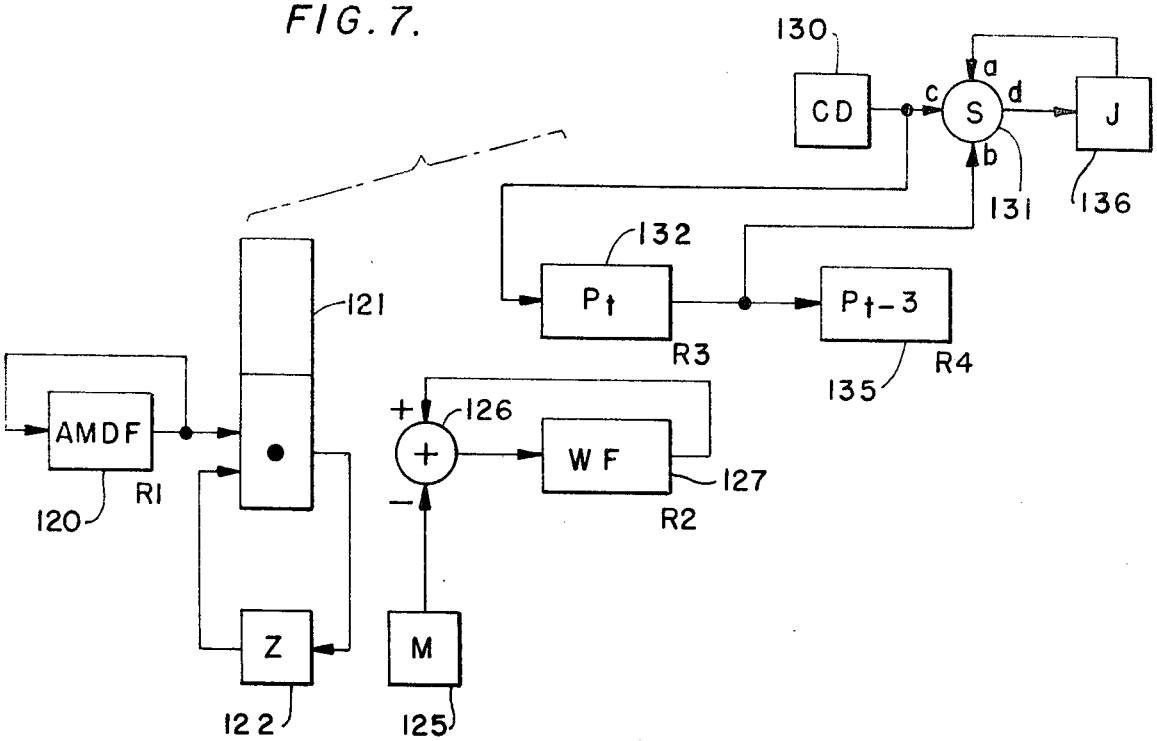
FIG. 7 is a block diagram of the phase 2 connection of the processor of FIG. 1.

FIG. 7 illustrates a diagram of phase two of the apparatus. It, and the diagrams of FIGS. 8 and 9 do not represent a different apparatus from that of FIG. 6, they merely represent different configurations of the same apparatus, with those registers which are inactive during a phase being omitted from the figure. This change is configuration may be accomplished by simple switching circuits operated between phases. In FIG. 7, a delay line 120 of 30 stages provides the $b_1$ input to a circuit 121 and to itself. The $b$ output of the circuit 121 is connected to a delay stage 122 which is connected to the $b_2$ input of the circuit 121. A storage element 125 provides the "−" input to an adder 126, whose output is connected to a delay line 127 of 30 stages. The "+" input to the adder 126 comes from the output of the delay line 127. A "count down" counter 130 is connected to the "$c$" input of a switch 131 and also to the input of a delay line 132 of 30 stages. The delay line 132 is connected to a delay line 135 of 30 stages and to the $b$ input of the switch 131. The "$d$" output of the switch is connected to a delay stage 136, which is connected to the $a$ input of switch 131.

Figure 8:
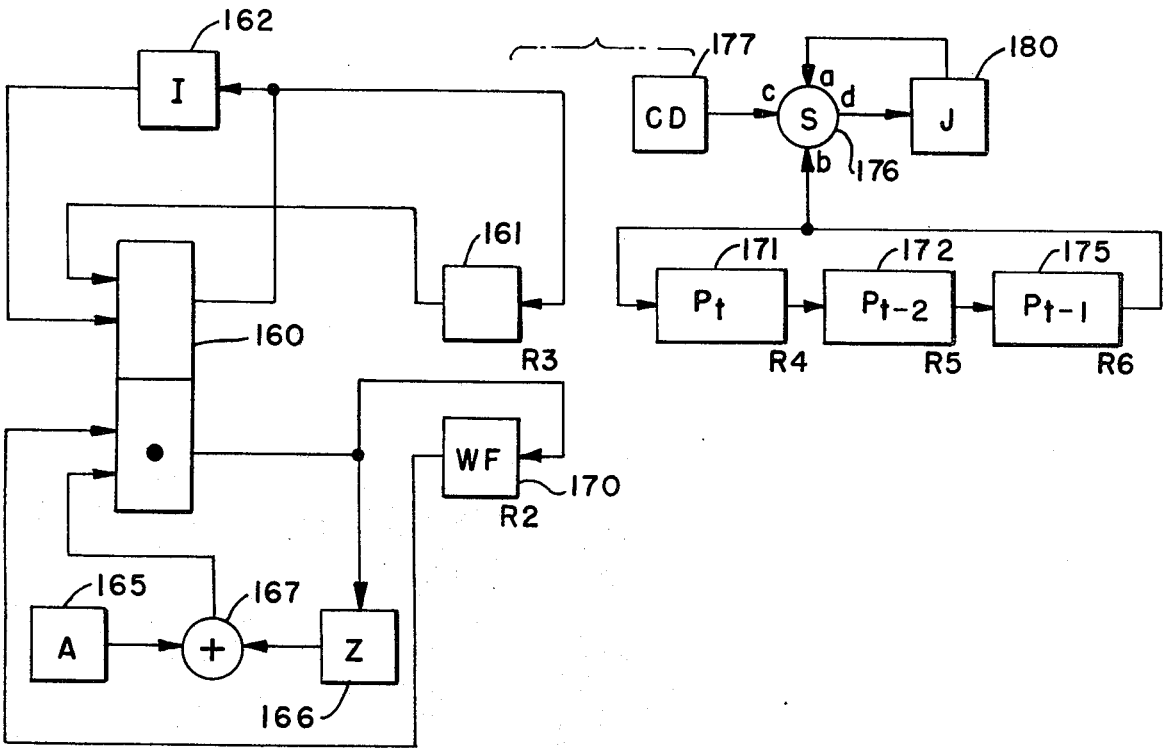
FIG. 8 is a block diagram of the phase 3 connection of the processor of FIG. 1.

The third phase of the processor operation is illustrated in FIG. 8. The $a_1$ and $a_2$ inputs of a circuit 160 come from a delay line 161 and a delay stage 162 respectively. The $a$ output of the circuit 160 is connected both to the stage 162 and the delay line 161. The contents of a storage element 165 and a delay stage 166 are summed by an adder 167, with that sum provided to the $b_2$ input of circuit 160. The $b$ output is connected to a delay line 170 and the stage 166. The delay line 170 provides the $b_1$ input to circuit 160. Three delay lines 171, 172, and 175 are connected in series, with delay line 171 connected to delay line 172, delay line 172 connected to delay line 175 and delay line 175 connected to delay line 171. Delay line 175 additionally provides the $b$ input to a switch 176. A count down counter 177 is connected to the $c$ input of switch 176 and a delay stage 180 is connected to the $a$ input of switch 176. The $d$ output of the switch 176 is connected to the stage 180.

Figure 9:
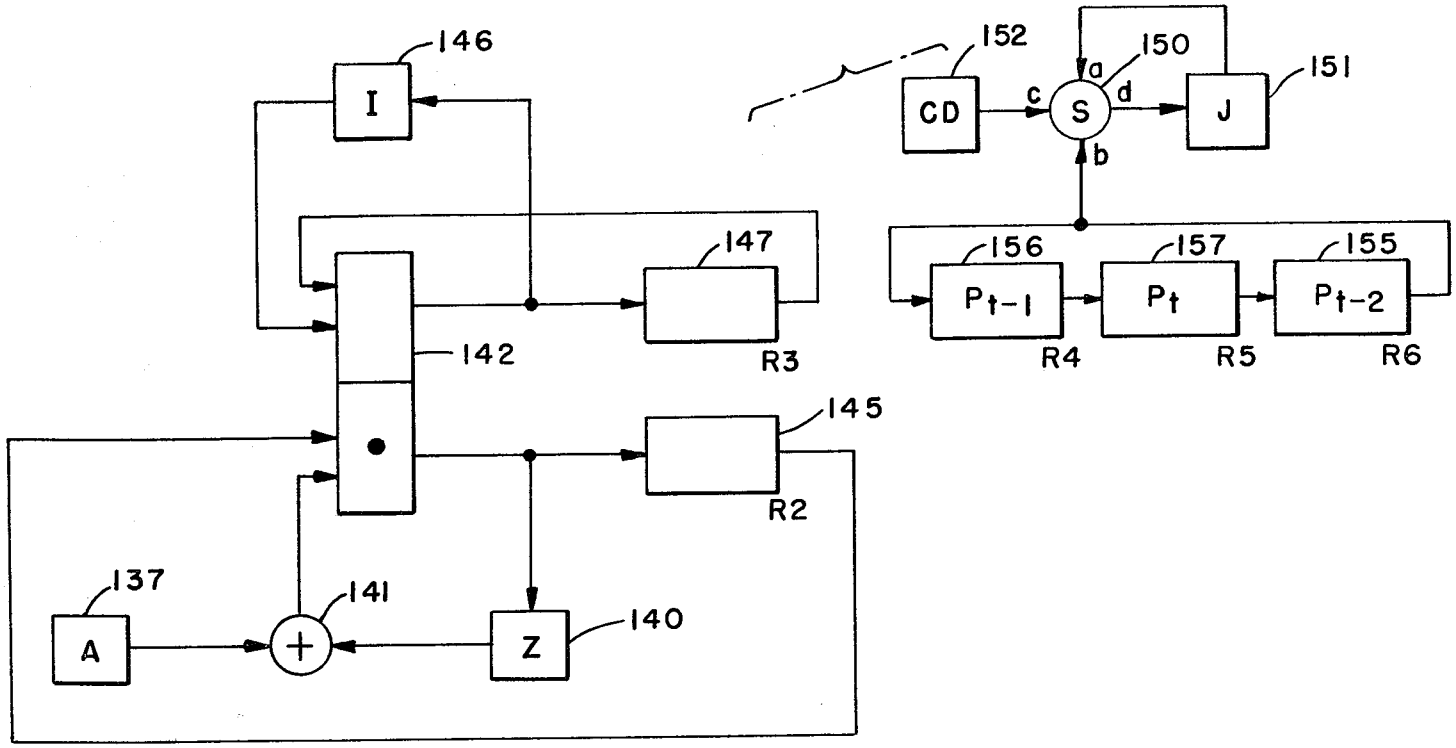
FIG. 9 is a block diagram of the phase 4 connection of the processor of FIG. 1.

FIG. 9 shows the phase four configuration of the processor apparatus. A storage element 137 and a delay stage 140 are connected to an adder 141, with the output provided to the $b_2$ input of a circuit 142. The $b$ output of the circuit 142 is connected to the delay stage 140 and to a delay line 145. The delay line 145 provides the $b_1$ input to circuit 142. The $a$ output of the circuit 142 is connected to a delay stage 146 and to a delay line 147, which provide the $a_2$ and $a_1$ inputs, respectively, of the circuit 142. The $a$, $c$, and $b$ inputs, respectively, of a switch 150 are received from a delay stage 151, a count down counter 152 and a delay line 155. The $d$ output of switch 150 is connected to stage 151. Delay lines 155, 156, and 157 are connected in series, with delay line 155 connected to delay line 156, delay line 156 connected to delay line 157, and delay line 157 connected to delay line 155.

By continuing to assume the sampling rates and bit lengths given previously, operable dimensions for the various delay lines and stages and the counters may be determined. The R1 delay line identified by the numeral 105 in FIG. 6 and by the numeral 120 in FIG. 7, must be large enough to hold the AMDF values generated by the apparatus of FIG. 1. A delay line 30 bits long by 12 bits will suffice. The delay line R2, designated 111 in FIG. 6, 127 in FIG. 7, 170 in FIG. 8 and 145 in FIG. 9 may be 30 bits long by 16 bits. The delay line R3, R4, R5, and R6 must be large enough to hold the generated pointer vectors; 30 bits long by 5 bits is acceptable. The delay stages designated I and J may be 1 by 5 bits and the stages designated A, M, and Z may each be 1 by 16 bits. The count down counters must generate the numbers 30 through 1, in that order. The delay lines R2 and R3 must be capable of shifting either from right to left or from left to right with appropriate switching.

Prior to the beginning of phase one operation, as illustrated by FIG. 6, a number of delay lines and stages must be preset. The count down counter 116 is preset to 30, the number of AMDF values to be evaluated per frame. The counter operates by decrementing its contents by one on each applied clock pulse. The stage 115, which after processing will contain the value of the minimum AMDF value, should be preset to the maximum value possible. Prior to processing of the first set of AMDF values, the contents of stage 112, delay line 105 and delay line 111 may be preset to 0. Thereafter, they will retain the contents held as a result of the completion of phase four as illustrated in FIG. 9 and described more fully herein below. The value J held in stage 112 will be the pitch index of the frame just evaluated and transmitted to output terminal 46 of FIG. 1. The value held in the R1 delay line 105 will be the AMDF values for the frame just evaluated, and the value in the R2 delay line 111 will be the intermediate winner function (IWF) for the preceeding frame. Phase one consists of a 30-step operation. The previous AMDF values are added to the IWF to produce the new winner function (WF) which is stored in the delay line 111. On each step, the just-generated component of the winner function is compared with the value stored in the stage 115, and the lesser of the two is stored in stage 115. At the end of the 30-step pass, stage 115 will contain the smallest of the WF components. Simultaneously, the stage 112 will sequentially store the location of the smallest WF component. While the old AMDF values are being fed from the R1 delay line to the adder 107, the R1 delay line is simultaneously filled with the 30 new AMDF values from the delay line 42 of FIG. 1.

Prior to initiating phase two, a preset step is necessary. The Z stage 122 must be preset with its maximum possible value and the J stage 136 must be preset with the value stored in stage 112 after the completion of phase one. The count down counter 130 must be preset with the value 30. On the initial pass, the contents of the delay line 132 and 135 are not relevant; thereafter, the R3 delay line 132 will contain the consecutive values 1 through 30 from counter 130, and the R4 delay line 135 will contain the previous contents of the R3 delay line 132. As in phase one, phase two consists of a single 30-step pass. During that pass, each component of the AMDF values stored in the R1 delay line 120 is compared by means of the circuit 121 with the current minimum value stored in the stage 122, with the lesser of the two values then stored at 122. At the end of the pass, the stage 122 will hold the smallest of the AMDF values. Simultaneously, the adder 126 subtracts the minimum of the AMDF values, stored in stage 125, from each of the WF components, stored in the R2 delay line 127, and reinserts the diminished WF in R2. At the same time, the count down counter 130 places the values 30, 29, 28, . . . 1 into the R3 delay line 132 as the contents of the R3 delay line are shifted into the R4 delay line 135.

The switch "S", identified by the numeral 131 in FIG. 7, 176 in FIG. 8 and 150 in FIG. 9, is a 3-input/1-output logic circuit which, if enabled: compares the values on inputs $a$ and $c$ and provides, as output $d$, the value on input $a$ if $a \neq c$, or the value on input $b$ if $a = c$. The switch is automatically disabled once the $a = c$ condition is reached. If a delay greater than one frame is desired for choosing the pitch index, the switch 131 will be enabled at the beginning of this pass, thereby storing in the stage 136 the pointer index $P_t(i)$ for the immediately preceeding pitch period.

Prior to the phase three operation, a preset step requires the setting of the stage 166 to its maximum possible value, the setting of the stage 162 to 30 and the setting of the stage 165 to the updated "$\alpha$" as computed from delay line 122 according to the rule set forth previously. The "count down" counter 177 will be preset to 30.

The operation of phase three, which completes the "left-to-right" process described previously, is accomplished in a 30-step pass. Each component of the winner function stored in delay line 170 is compared with the sum of the "$\alpha$" value stored in stage 165 and the value stored in stage 166. The lesser of the two are passed by the $b$ output of circuit 160 and stored in stage 166 and in the first stage of the delay line 170 as the contents of that delay line shift from right to left. In a concurrent operation, the index identifying the source of that least value stored in stage 166 is stored in the I stage 162 when selected by the circuit 160 from the contents of the I stage and the R3 delay line 161. If the pitch period selection is to be delayed more than two frames, the switch 176 is enabled to compare the value stored in the J stage 180 with the value in the counter 177. So long as the values are not equal, the value in the J stage remains unchanged; once the two values are equal, the value on the $b$ input from register 175 is stored in the J stage 180 and the switch 176 is disabled. At this point, the value held in the J stage 180 is the pointer index traced back two frames. During this operation, the contents of the R6 delay line 175 are transferred to the R4 delay line 171, the contents of the R4 delay line are transferred to the R5 delay line 172 and the contents of the R5 delay line are transferred to the R6 delay line.

The fourth phase of the operation, shown in FIG. 9, begins after the presetting of the count down counter 152 to 30. This phase performs the right-to-left process described earlier and, if the choice of pitch period is to be delayed more than 3 frames, traces the pitch index back one more frame if the circuit 150 is enabled. By stepping the apparatus 30 times, the circuit 142 compares each component of the vector stored in the R2 delay line 145 (shifted from left to right) with the sum of the $\alpha$ value stored in stage 137 and the value stored in stage 140. The lesser of these two values is sequentially stored in the stage 140 and shifted into the delay line 145. Simultaneously, the circuit 142 keeps in the I stage 146 the value which came from the R3 delay line 147 the last time that the signal on the $b_1$ input of circuit 142 was shifted into stage 146. The value in the I stage 146 is also shifted into the R3 delay line 147. If the pitch period decision is to be delayed three or more frames the enabled switch 150 compares the $a$ and $c$ inputs, leaving the value stored in stage 151 unchanged until that value and the value in the counter 152 compare. Upon that occurrence, the value on the $b$ input is stored in stage 151 and the switch 150 is disabled. Concurrently, the values stored in the R6 delay line 155 are transferred to the R4 delay line 156, the contents of the R4 delay line are transferred to the R5 delay line 157, and the contents of the R5 delay line are transferred to the R6 delay line. Upon completion of phase four, the analysis of one frame of speech has been completed and the apparatus is ready to be returned to the phase one state for analysis of additional frames of speech.

Figure 10:
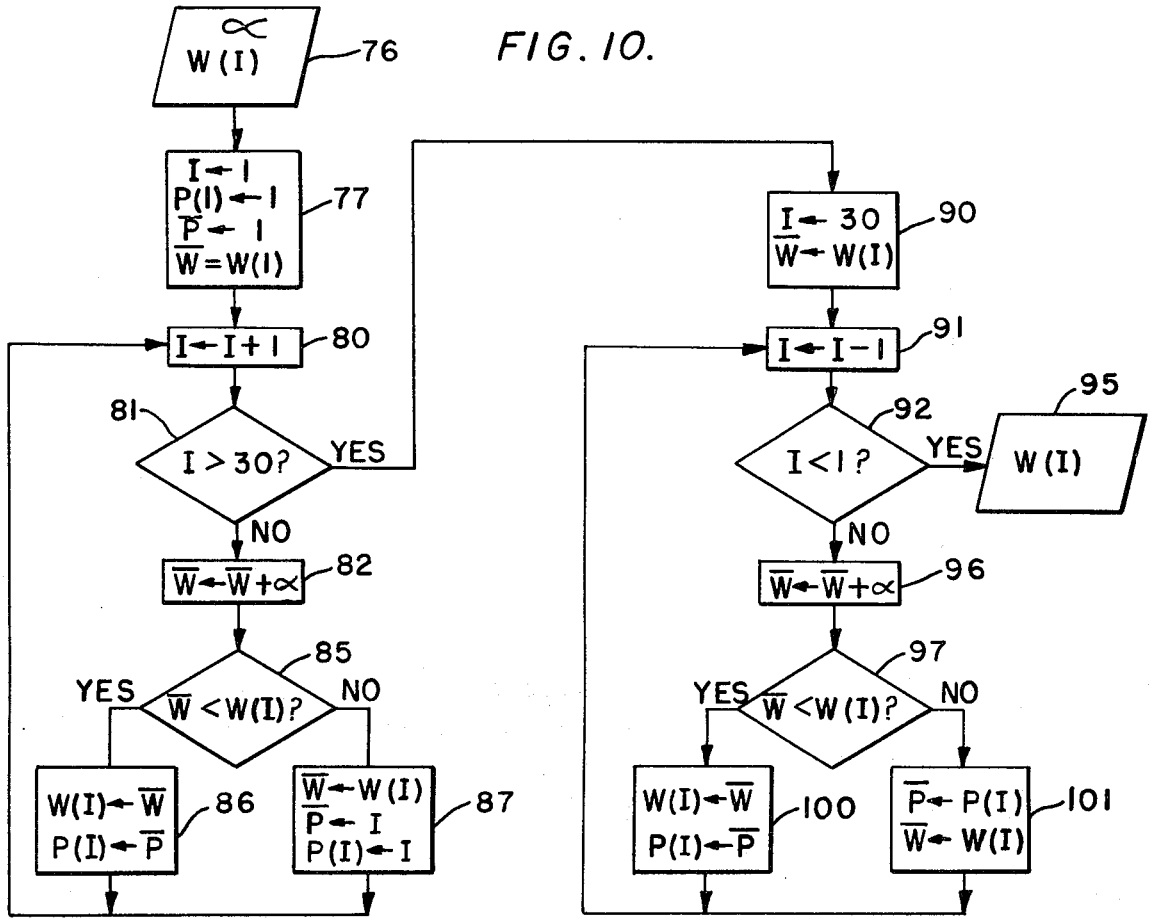
FIG. 10 is a flow chart of part of phases 3 and 4 of the process for selecting the best pitch value, which could be used in a programmable implementation of the processor of FIG. 1.

The operations during phases 3 and 4 of the delay lines R2 and R3, and the various components they access, is described in a flow chart depicting a means for computer implementation in FIG. 10. The process begins at 76 with the W vector representing the contents of the R2 delay line 170 at the beginning of phase 3, and the value $\alpha$ representing the contents of the storage element 165 at the beginning of phase 3. At 77, an initialization occurs in which the first component of the pointer vector P (1) and a temporary comparison variable $\overline{P}$ are given the integer value 1. A variable I is initialized to 1 to provide a counting indicator, and a comparison variable $\overline{W}$ is given the value of the first component of W. At 80 the counter value I is incremented. A decision occurs at 81; when the counter is greater than 30, phase 3 is completed and the processor shifts to 90 to begin phase 4. If the counter I is not greater than 30, $\overline{W}$ is replaced with the value of $\overline{W}+0$ $\alpha$ at 82. A decision then occurs at 85 to determine whether the pitch trajectory value, $\overline{W}$, is greater than or less than the computed value W(I). If the trajectory value is less, at 86 the old W(I) is replaced with the pitch trajectory $\overline{W}$. The pointer P(I) corresponding to W(I) is replaced with $\overline{P}$. Conversely, if $\overline{W}$ is greater than W(I), at 87 $\overline{W}$ is replaced with W(I) and $\overline{P}$ and P(I) are replaced with the value I. Regardless of whether $\overline{W}$ is greater than or less than W(I), after the proper value substitutions at 86 or 87 the processor returns to 80 for incrementing of the counter I and continuation of the analysis.

Once the process has analyzed the old winner function from left to right as described, a similar analysis for phase 4 is performed from right to left beginning at 90. There, the counter I is initialized with the value 30. In the computer implementation, a saving could be realized by initializing the counter I with the value $\overline{P}$. This has the effect of immediately beginning the analysis at the left-most point of the right-pointing ray ending at $i = 30$. This provides a substantial increase in processor speed by eliminating the need to compare the values along the right-pointing rays which have already been analyzed. Also at 90, $\overline{W}$ is replaced with W(I). At 91, the counter I is reduced by 1, and the result is compared with the value 1 at 92. If I is less than 1, the analysis has gone full circle from W(1) to W(30) and back to W(1). The resulting W vector at 95 is ready to be added to the new AMDF values at adder 61 for processing of the next frame of speech. If I is not less than 1, there are more W values to be processed. $\overline{W}$ is replaced by $\overline{W}+\alpha$ at 96, and at 97 the new $\overline{W}$ is compared with W (I). If $\overline{W}$ is less than W (I), W(I) is replaced with $\overline{W}$ and P(I) is replaced by $\overline{P}$ at 100. If $\overline{W}$ is not less than W(I), then $\overline{P}$ is replaced by P(I) and $\overline{W}$ is replaced by W(I) at 101. In the computer implementation a further saving can be realized by also replacing I by P(I) at 101. In either case 100 or 101, the processor returns to 91 and continues.

For purposes of this description, a specific bit length was assumed for the various counters and delay lines so that the examples given previously could remain consistent. It is to be understood that the sampling rates, number of samples, and bit lengths may all be changed by one skilled in the art to meet varying requirements without departing from the scope and intent of this invention.

I claim:

1. A pitch analyzer, comprising:

means for digitizing an analog speech signal;

a delay line into which said digitized signal may be sequentially inserted;

means for periodically extracting the contents of selected stages of the delay line, the selected stages being spaced at substantially logarithmic intervals; and means for periodically testing said extracted contents to determine an optimum choice of pitch period.

2. The pitch analyzer of claim 1, wherein the length of said delay line is sufficient to store a sample of speech having greater length than the greatest anticipated pitch period.

3. The pitch analyzer of claim 2, wherein each column of the delay line stores one sample of speech information.

4. The pitch analyzer of claim 3, wherein the contents of the delay line is sampled at a rate which is a reciprocal of an integer times the delay line stepping rate.

* * * * *